United States Patent [19]

Signorelli

[11] Patent Number: 4,614,097

[45] Date of Patent: Sep. 30, 1986

[54] INTERNAL LOCKING MECHANISM FOR BARREL TYPE LOCKS

[76] Inventor: John A. Signorelli, 2150 E. 29th St., Brooklyn, N.Y. 11229

[21] Appl. No.: 824,304

[22] Filed: Jan. 30, 1986

Related U.S. Application Data

[63] Continuation-in-part of Ser. No. 519,999, Aug. 3, 1983, abandoned, which is a continuation-in-part of Ser. No. 232,137, Apr. 27, 1981, abandoned.

[51] Int. Cl.[4] ..... E05B 67/36

[52] U.S. Cl. ..... 70/34; 70/386; 70/395

[58] Field of Search ..... 70/23, 32–34, 70/386, 395, 397–398, 402–404

[56] References Cited

U.S. PATENT DOCUMENTS

| | | | |
|---|---|---|---|
| 1,499,444 | 7/1924 | Caillois | 70/386 |
| 1,923,025 | 8/1933 | Morse | 70/34 |
| 3,033,016 | 5/1962 | Moberg | 70/395 |
| 3,478,548 | 11/1969 | Finck | 70/397 |
| 3,714,802 | 2/1973 | Morse | 70/34 |
| 3,835,674 | 9/1974 | Hoyt | 70/34 |
| 3,914,965 | 10/1975 | Paxton | 70/34 |
| 4,015,456 | 4/1977 | Moberg | 70/34 |
| 4,040,279 | 8/1977 | Signorelli | 70/34 |
| 4,058,992 | 11/1977 | Nielsen | 70/34 |
| 4,155,232 | 5/1979 | Haus | 70/34 |

FOREIGN PATENT DOCUMENTS

| | | | |
|---|---|---|---|
| 407023 | 6/1974 | U.S.S.R. | 70/386 |

*Primary Examiner*—Robert L. Wolfe

*Attorney, Agent, or Firm*—Brooks Haidt Haffner & Delahunty

[57] ABSTRACT

A plunger type lock comprising a barrel with an axial bore, locking members in the form of balls housed in the barrel wall and extensible outwardly from the barrel by a plunger axially slidable within the barrel bore, at least one further ball housed in an opening in the wall of the plunger and extensible outwardly therefrom and a peripheral groove on the inner wall surface of the barrel for receiving the further ball, the further ball being forceably moved and held in the barrel's groove by an incorrect key, instrument or an implement to prevent and resist movement of the plunger whenever an unauthorized attempt to operate and open the lock is made.

24 Claims, 19 Drawing Figures

Fig. 1.
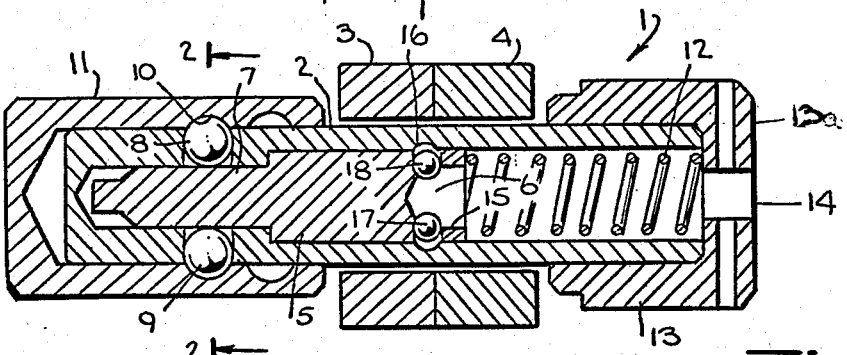
Fig. 2.
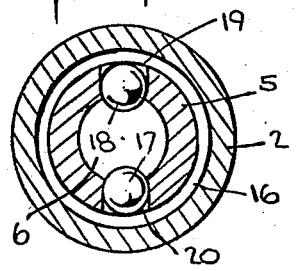
Fig. 3.
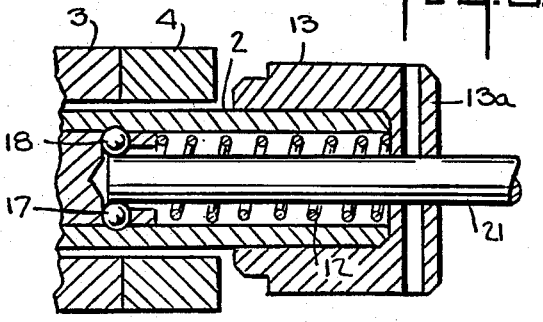
Fig. 4.
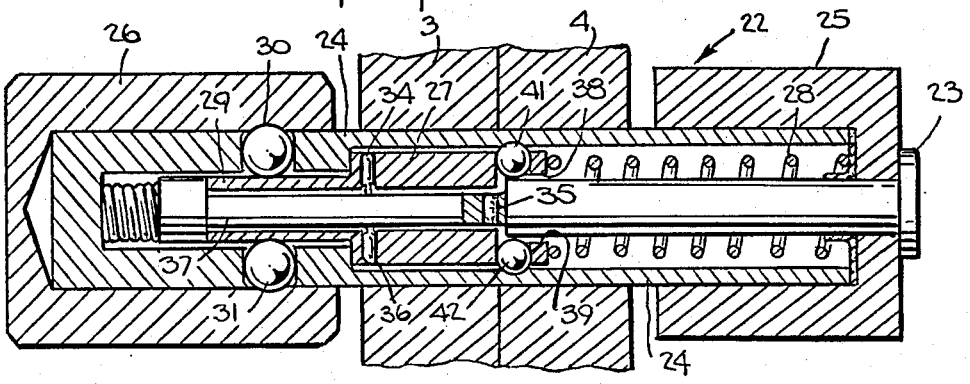
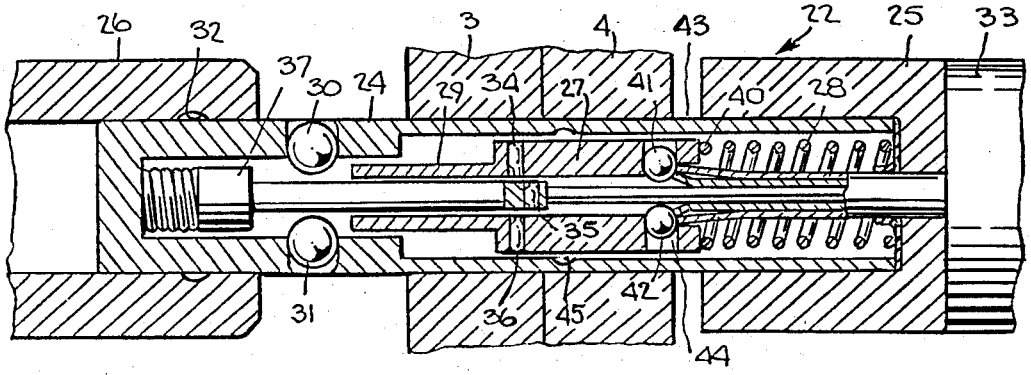
Fig. 5.

Fig. 6A.
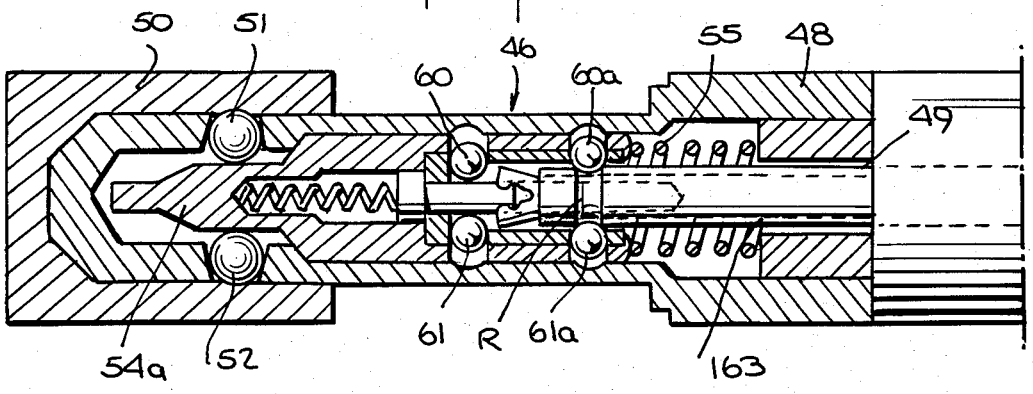
Fig. 7B.
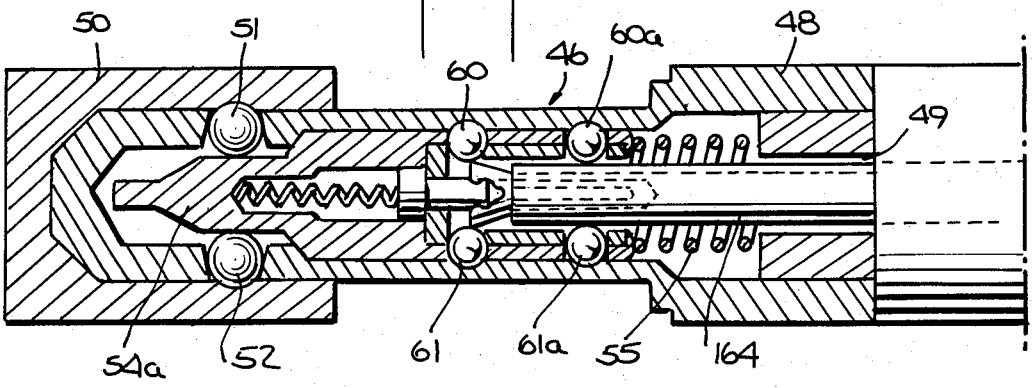
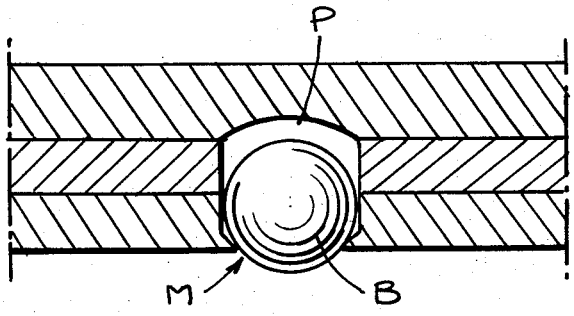
Fig. 10.

INTERNAL LOCKING MECHANISM FOR BARREL TYPE LOCKS

CROSS-REFERENCE TO RELATED APPLICATION

This application is a continuation-in-part of application Ser. No. 519,999, filed Aug. 3, 1983 and now abandoned which was a continuation-in-part of U.S. Ser. No. 232,137 filed Apr. 27, 1981 and now abandoned.

BACKGROUND OF THE INVENTION

1. Field of the Invention

The invention relates to plunger type locks and particularly to locks which have an operating mechanism which is unlocked when a key is inserted axially into the lock to the proper depth and then partially withdrawn.

2. Description of the Prior Art

Plunger type locks are disclosed in U.S. Pat. Nos. 3,002,368; 3,714,802; 3,033,016; 3,478,548; 3,835,674; 4,015,456; 4,040,279; 4,058,992 and 4,155,232 and are relatively widely used to prevent tampering with gas, water and electric meters, unauthorized operation of valves and switches, etc. In general, such locks have a hollow barrel containing a plunger axially movable in the barrel from a locking position to an unlocking position, the plunger being spring biassed into the locking position. One end of the barrel is receivable in a cap or housing having a recess or groove. In the locking position of the plunger, a plurality of locking members, in the form of steel balls are held by the plunger, partly extending outwardly of the barrel and received in the recess of the cap or housing so that the barrel cannot not be removed from the cap or housing.

To unlock the lock of some prior art constructions, and thereby to permit separation of the barrel from the cap or housing, a key with spreadable fingers at its end is inserted into an opening in one end of the barrel and is moved lengthwise or axially of the barrel until the fingers are received within a socket at the end of the plunger, at which time, the fingers are spread apart causing them to engage the wall of the socket in the plunger. Thereafter, as the key is moved axially in a direction opposite to the key insertion direction, the plunger moves axially of the barrel permitting the steel balls to move inwardly of the barrel and out of the recess in the cap or housing.

In other types of plunger type locks, e.g. those disclosed in U.S. Pat. Nos. 3,478,548; 4,015,456 and 4,058,992, the operation is similar except for the use of a "grabber" type key to grab or grip a pin associated with the plunger rather than a key with spreadable fingers for engaging the wall of a socket in the plunger.

It is known in the lock art that persons seeking unauthorized access to utility meters, gas shut-off valves, current transformer cabinets, switches, etc., are resourceful and adopt ingenious ways to open the locks used. As a consequence, considerable effort has been devoted to the development of economical and sturdy locks for locking such devices which are resistant to opening thereof by unauthorized means. One type of expedient used by unauthorized persons is a nail, rod, tubing or improvised tool inserted into the lock in such a manner as to engage the wall of the plunger socket upon retraction of such nail, rod, tubing or tool in the same way that it is moved by a correct key. Another expedient is to obtain unauthorized access to an incorrect key and to manipulate such incorrect key in a way which will cause unlocking movement of the plunger.

One object of the invention is to provide a plunger type lock in which the plunger is locked in its locking position whenever an attempt is made to pick the lock with an implement which can be inserted into the lock farther than an authorized key can be inserted therein and/or whenever a key or implement not having the correct keying positions of an authorized key is used.

Another object of the invention is to make locks of the type which are operable by a "grabber" type key more resistant to picking by an improper key or an implement other than a key by locking the plunger in its locking position whenever an attempt is made to pick the lock with such a key or implement.

SUMMARY OF THE INVENTION

In one preferred embodiment of the invention, the plungers of known types of plunger locks are modified to include one or more further locking member or members in the form of a steel ball or balls at a portion of the key receiving socket which is farther from the key receiving end of the lock than the surface of the wall of such socket which is normally engaged by correct, authorized key. Such ball or balls co-operate with a recess or groove at the interior wall of the barrel in such a manner that when an implement other than a correct key is inserted in the lock, the ball or balls enter the recess in the barrel and prevent axial movement of the plunger, thereby not allowing the conventional locking balls to be received by the barrel and thus maintain the locking mode.

In modified embodiments of the invention in which the positions of the conventional locking balls of the lock are determined by the position of a movable pin which is grippable by a "grabber" key, the further locking member or members of the preferred embodiment are either positioned by the movable pin whereby displacement of the pin by an incorrect implement will prevent release of the conventional locking balls or positioned by an implement other than a correct key so as to prevent release of the conventional locking balls.

Other objects and advantages of the present invention will be apparent from the following detailed description of the presently preferred embodiments thereof, which description should be considered in conjunction with the accompanying drawings in which:

BRIEF DESCRIPTION OF THE DRAWING

FIG. 1 is an axial, cross-sectional view of the plunger type lock shown in U.S. Pat. No. 3,714,802 modified to incorporate the invention;

FIG. 2 is a cross-sectional view taken along the line 2—2 indicated in FIG. 1;

FIG. 3 is a fragmentary, cross-sectional view similar to FIG. 1 but showing the effect of inserting a tube or rod, rather than the proper key, into the lock shown in FIG. 1;

FIG. 4 is an axial, cross-sectional view of the plunger type lock shown in U.S. Pat. No. 4,040,279 modified to incorporate the invention;

FIG. 5 is similar to FIG. 4 but shows the positions of the parts when the lock is unlocked;

FIGS. 6A and 7A show modified versions of the mechanisms of FIGS. 6 and 7 which employ additional locking balls;

FIG. 10 is a detail view in cross-section showing means for retaining a locking ball.

DESCRIPTION OF PREFERRED EMBODIMENTS

Figure 3A:
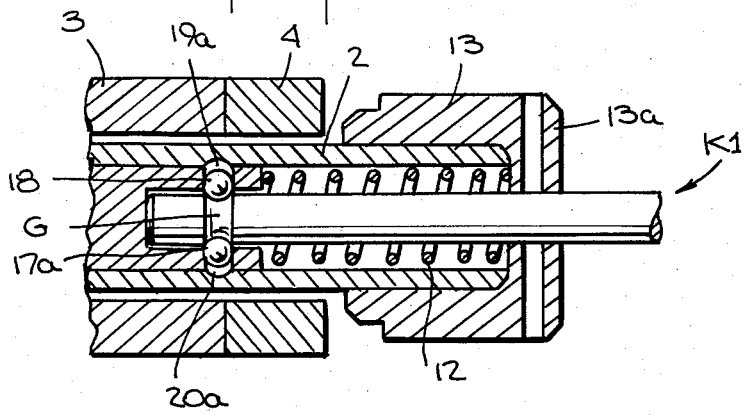
FIGS. 3A, 3B and 3C show different ways of positioning one or more sets of locking balls for use with a key having one or more circumferential grooves.

Except for the modifications required for the purpose of the invention, the lock 1 illustrated in FIGS. 1–3 is the same as the lock illustrated in U.S. Pat. No. 3,714,802 and only a brief description of the latter lock will be included herein. Thus, the lock 1 includes a tubular barrel 2 closed at one end which passes through openings in the parts 3 and 4 to be locked relative to each other. A plunger 5 is slidably mounted, for axial movement, within the barrel 2 and has a socket 6 at one end from which the sleeve 33 of U.S. Pat. No. 3,714,802 has been removed. The end portion 7 of the plunger 5 maintains the locking members 8 and 9, in the form of steel balls, in a peripherally extending groove 10, in a cap 11 when the lock is locked thereby preventing separation of the cap 11 and the barrel 2.

The plunger 5 is urged toward the locking position thereof by a spring 12 acting between an end of the plunger 5 and a further cap 13 secured to the barrel 2, such as by reason of a press fit therebetween. As described in U.S. Pat. No. 3,714,802, the lock 1 may be unlocked by means of a key which has an expandable end and which is of the proper length, the key being inserted into the barrel 2 by way of the keyhole 14 and the expandable end thereof engaging the wall portion 15 of the socket 6. When the key is so inserted and the end thereof is expanded, the key is then partially withdrawn from the barrel 2 causing the plunger 5 to move to the right, as viewed in FIG. 1, which permits the locking members 8 and 9 to move inwardly of the barrel 2 and out of the groove 10 and permits removal of the cap 11 from the barrel 2.

In accordance with the invention, a further peripheral groove 16 is provided on the inner wall of the barrel 2 and one or more further locking members, such as steel balls 17 and 18, are mounted in passageways 19 and 20 (FIG. 2) in the barrel 2 at a distance from the outer end 13*a* of the cap 13 and greater than the distance of the wall portion 15 from the outer end of the cap. The passageways 19 and 20 extend from the interior of the socket 6 to the exterior of the plunger 5 and permit portions of the balls 17 and 18 to enter into the groove 16. The inner ends of the passageways 19 and 20 are shaped and have dimensions, e.g. a diameter less than the diameter of the balls 17 and 18, to prevent the balls 17 and 18 from falling into the socket 6. However, the inner ends of the passageways 19 and 20 are dimensioned so as to allow a portion, preferably one-quarter of the ball sphere, to extend into the socket 6. Also, the diameters of the balls 17 and 18 are larger than the thickness of the walls of the socket 6 where the balls 17 and 18 are located, but preferably the diameters of the balls 17 and 18 are such that there is at least a small spacing therebetween when they are at their radially innermost positions.

Usually, the expandable key used to open the lock 1 has an abutment thereon which abuts the outermost end 13*a* of the cap 13 when the expandable end of the key is in the position in which it can engage the wall portion 15. Therefore, a correct key can unlock the lock 1 without moving the balls 17 and 18 into the groove 16. However, if an incorrect key having a greater spacing between such abutment and the expandable end is inserted into the barrel 2 until the abutment thereon abuts the end 13*a*, the expandable end thereof will move the balls 17 and 18 radially outwardly into the groove 16, and when an attempt is then made to retract the incorrect key, the plunger 5 is prevented from moving by reason of the engagement of the balls 17 and 18 with the wall of the groove 16.

Similarly, when an implement 21, such as a rod or tube which has a diameter large enough to frictionally engage the wall portion 15, is driven into the barrel 2 through the keyhole 14 and beyond the side of the wall portion 15 remote from the end 13*a*, as illustrated in FIG. 3, in an attempt to unlock the lock 1, the implement 21 will similarly move a portion of the balls 17 and 18 into the groove 16 and prevent axial movement of the plunger 5 and release of the balls 8 and 9.

Although two balls 17 and 18 have been shown in FIGS. 1–3 and will be shown in the figures described hereinafter, it will be apparent that only one ball, 17 or 18, or more than two balls 17 and 18 may be used.

FIGS. 4 and 5 illustrate the use of the invention in connection with a plunger type lock of the type illustrated and described in U.S. Pat. No. 4,040,279 and reference is made to the latter patent for a complete description of the lock parts and operation thereof other than the parts added thereto for the purpose of the invention. Only a brief description of the lock parts and operation will be set forth herein.

FIG. 5 illustrates the lock 22 in its locked condition with a protective pin 23 therein, and FIG. 5 illustrates the lock 22 in its unlocked condition. The lock 22 has a barrel 24 with a cap 25 secured to one end thereof, for example, by frictional fit and a cap or housing 26 at the other end thereof. A plunger 27 is axially slidable within the barrel 24 and is urged into its locking position by a spring 28 acting between one end of the plunger 27 and the cap 25. In its locking position, a portion 29 of the plunger 27 holds the locking members 39 and 31, in the form of steel balls, in a peripheral groove 32 (FIG. 5) in the cap 26 so that the cap 26 cannot be separated from the barrel 24. When the plunger 27 is retracted by a key 33, as shown in FIG. 5, the balls 30 and 31 are permitted to move inwardly of the barrel 24, and the cap 26 may be separated from the barrel 24. Parts of a frangible member included for the purposes described in said U.S. Pat. No. 4,040,279 are designated by the reference numerals 34, 35 and 36, and the piston described in said last-mentioned patent is designated by the reference numeral 37.

The plunger has a socket 38 at the end thereof nearest the cap 25, and the socket 38 has a wall portion 39 which is engageable by the expandable fingers 40 of the key 33 for the purpose of moving the plunger 27 axially and thereby, releasing the balls 30 and 31 and unlocking the lock 22.

For the purposes of the invention, a further pair of locking members, in the form of steel balls 41 and 42, are received in passageways 43 and 44 in the wall of the barrel 27. The passageways 43 and 44 have the shape and dimensions described in connection with the passageways 19 and 20 shown in FIGS. 1–3, and the balls 41 and 42 have the dimensions described in connection with the balls 8 and 9 shown in FIGS. 1–3. When the plunger 27 is in its locking position and the balls 41 and 42 are moved outwardly of the barrel 24, portions of the balls 41 and 42 are received in a peripheral groove 45 in the inner wall of the barrel 24. On the other hand, if the wall portion 39 is engaged by the expandable fingers 40 of a correct key 33, the balls 41 and 42 are free to move inwardly and do not impede axial movement of the plunger 27.

Accordingly, as described in connection with FIGS. 1–3, an implement or incorrect key which is inserted into the barrel 24 far enough to displace the balls 41 and 42 outwardly of the plunger 27 cannot move the plunger 27 because of the entry of the balls 41 and 42 into the groove 45. However, a correct key 33 can engage the wall portion 39 of the socket 38 without displacing the balls 41 and 42 outwardly of the plunger 27 and can move the plunger 27 to unlock the lock 22.

Figure 3B:
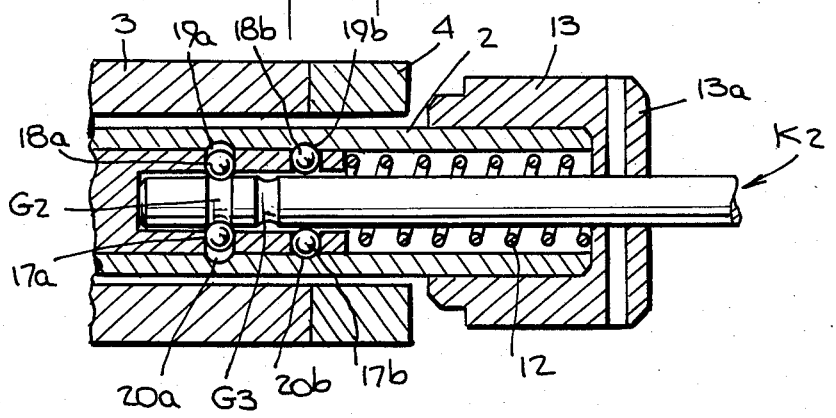
Figure 3C:
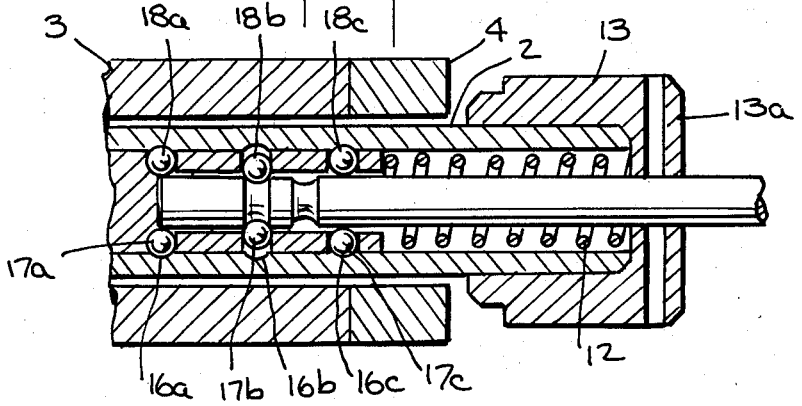

FIGS. 3A, 3B and 3C show modifications of the mechanism of FIG. 3 utilizing locking members which are not located near the bottom, or closed end, of the socket 6 of the plunger 5. This modification permits for greater variety in the combinations of lock and key which can, for example, be provided to different users, so that one user's key will not open another user's lock.

The mechanism of FIG. 3A has locking balls **17*a* and 18*a* which are similar to the balls 17 and 18 of FIG. 3, but which are mounted to move radially in and out of passageways 19*a* and 20*a*, which passageways are spaced away from the bottom of the socket 6. FIG. 3A shows in simplified form, an authorized key K1 in position to open the lock. The key K1 would be a key having an expandable end as described in U.S. Pat. No. 3,714,802 with fingers that spread outward to engage the wall of the socket 6, but for simplicity the finger details are omitted. The key K1 (actually the fingers at the end of the key) receives the locking balls 17*a* and 18*a* in the arcuate recess G which is opposed to the passageways 19*a* and 20*a* when the key K1 is in position to open the lock, i.e. inserted fully into the socket 6 as shown. An unauthorized key, such as the implement 21 shown in FIG. 3, or even a key having spreadable fingers but no recess G, or with a recess located at a different location with respect to the distal end of the key, would push the locking balls 17*a* and 18*a* outward into groove 16*a*** and prevent the axial movement of the plunger necessary to unlock the lock.

The lock of FIG. 3B has locking balls **17*a* and 18*a* like those shown in FIG. 3A, as well as additional locking balls 17*b* and 18*b*. To accomodate these additional locking balls 17*b* and 18*b* the socket 6 may be somewhat deeper or longer as shown in FIG. 3B. The key K2 illustrated in FIG. 3B has arcuate recesses G2 and G3, and would open the lock of FIG. 3B if those grooves G2 and G3 were properly located along the length of the key K2 when spreadable fingers (not shown) of the key K2 were spread apart to engage the walls of the socket 6. However, the key K2 shown in FIG. 3B has its second groove or recess G3 located too close to the recess G2 to receive the second set of locking balls 17*b* and 18*b*, so it cannot open the lock of FIG. 3B. If the second recess G3 were properly positioned opposite the passageways 19*b* and 20*b* when the key K2 was fully inserted into the socket 6**, it would function to open the lock.

FIG. 3C illustrates a similar result with a plunger 5 having three sets of locking balls, **17*a* and 18*a*, 17*b* and 18*b* and 17*c* and 18*c*, located at spaced positions along the length of the socket 6 for a locking fit within grooves 16*a*, 16*b* and 16*c* when an implement which lacks recesses to receive all of the locking balls is inserted into the socket. A proper key to unlock the mechanism of FIG. 3B would be dimensioned so as not to push any of the locking balls outward into the grooves 16*a*–16*c*. The correct key must thus be of the proper length and also have recesses correctly spaced. As indicated with respect to FIG. 3 the proper key would abut against the end surface 13*a* to prevent insertion so deep as to displace the innermost locking balls 17*a* and 18*a*** outwardly.

Figure 6:
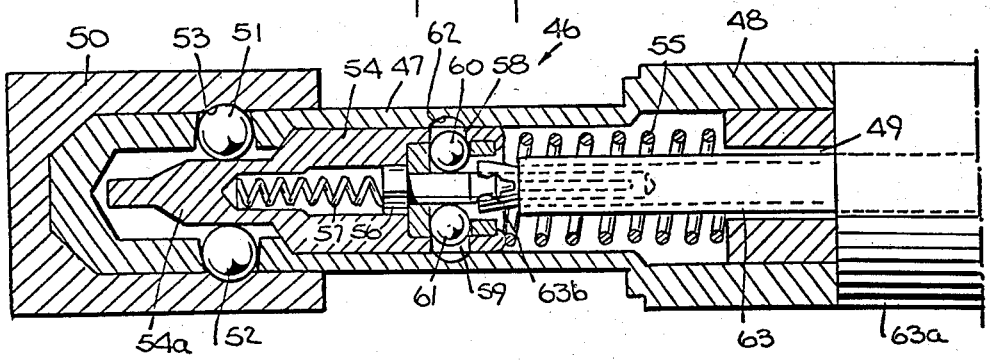
FIGS. 6 and 7 are axial, cross-sectional views of the plunger type lock shown in U.S. Pat. No. 4,015,456 modified in a first way to incorporate the invention.
Figure 7:
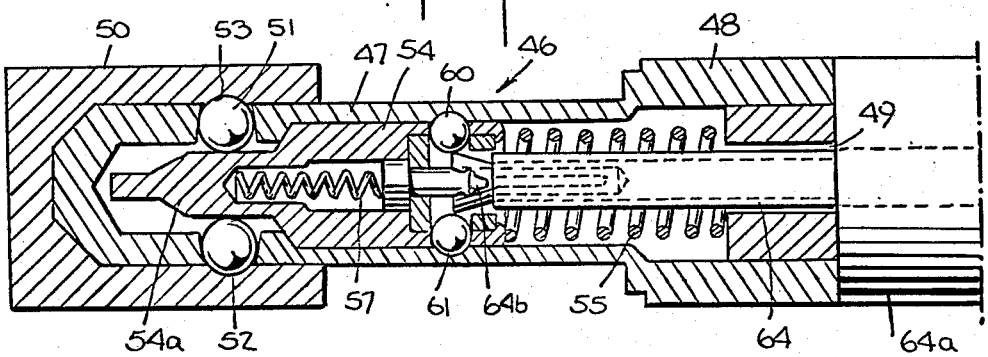
Figure 8:
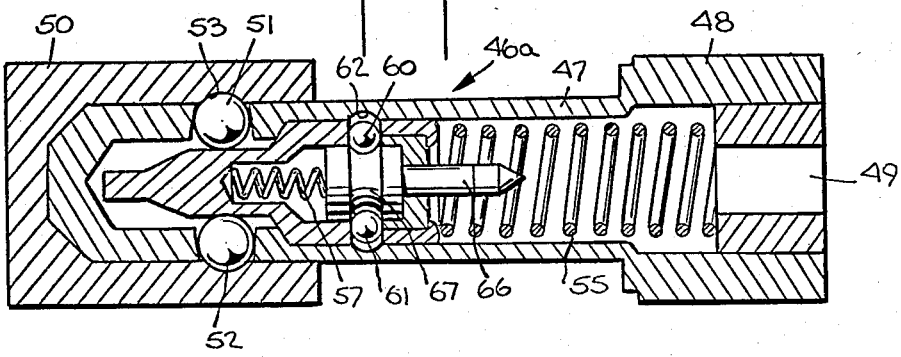
FIGS. 8 and 9 are axial, cross-sectional views of the plunger type lock shown in U.S. Pat. No. 4,015,456 modified in a second way to incorporate the invention.
Figure 9:
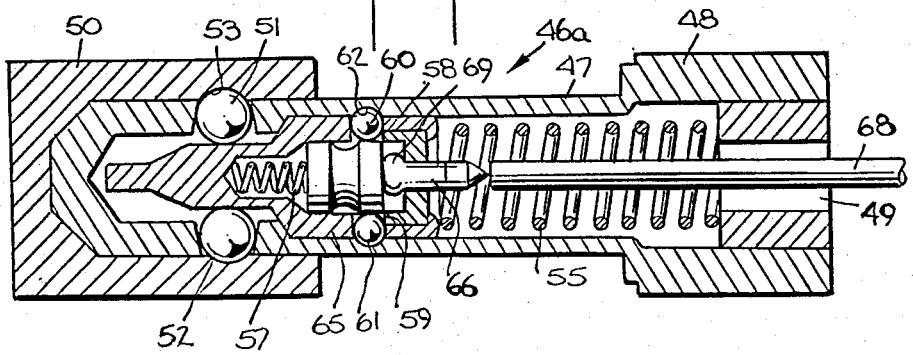

FIGS. 6–9 illustrate modified forms of the plunger type lock requiring a "grabber" key which is shown in U.S. Pat. No. 4,015,456. FIGS. 6 and 7 illustrate one way in which such lock may be modified to incorporate the invention, and FIGS. 8 and 9 illustrate another way in which such lock may be modified to incorporate the invention. While not essential, such lock may be modified to include both of the modifications disclosed in FIGS. 6 and 7 and in FIGS. 8 and 9.

The lock parts common to the lock of the invention and to the lock shown in said U.S. Pat. No. 4,015,456, and their functions and operation, are described in detail in said patent and will be described only briefly herein.

The locks 46 and **46*a* shown in FIGS. 6–9 comprise a barrel 47 with an enlarged head 48 having a keyhold 49. A cap 50 is held on the barrel 47, when the lock is locked, by steel balls 51 and 52 held in a peripheral groove 53 in the inner wall of the cap 50, as described hereinafter, such cap 50 corresponding to the caps 11 and 26 described hereinbefore. Lock 46 has a plunger 54 which is axially slidable within the barrel 47 and which is a modified form of the plunger shown in U.S. Pat. No. 4,015,456 but which performs the functions described in the patent. The plunger 54 is biassed into its locking position by a spring 55 and has a portion 54*a* which maintains the balls 51 and 52 in the groove 53 when the plunger 54 is in its locking position. The plunger 54 has a pin 56 and a spring 57 therein, the pin 56 being movable axially of the plunger 54**.

The plunger 54 has a pair of passageways 58 and 59 therein for loosely receiving a pair of locking members in the form of steel balls 60 and 61 and the barrel 47 has a peripheral groove 62 for receiving the balls 60 and 61. The passageways 58 and 59 are shaped and dimensioned and the balls 60 and 61 are dimensioned as described hereinbefore in connection with the passageways 19 and 20 and the balls 17 and 18 respectively.

When a correct key 63 is inserted into the lock 46 as shown in FIG. 6, the end of the key 63 can grab the pin 56 without interfering with radially inward movement of the balls 60 and 61, and therefore, the key 63 may be retracted after the end thereof grabs the pin 56 causing the plunger 54 to move to the right, as viewed in FIG.

6, and thereby moving the portion 54a to a position such that the balls 51 and 52 can move inwardly out of the groove 53. When the balls 51 and 52 move out of the groove 53, the cap 50 may be removed from the barrel 47.

Key 63 has an abutment 63a thereon which engages the key receiving end of the barrel 47 when the key 63 is fully inserted, and the spacing between the abutment and the fingers 63b of a correct key 63 is such that the fingers 63b do not interfere with inward movement of the balls 60 and 61. After the key 63 is inserted to its full depth and the fingers 63b are around the pin 56, the fingers 63b are retracted while the outer tube and the abutment 63a of the key 63 are held stationary which causes the fingers 63b to grab or grip the pin 56. After the fingers 63b grip the pin 56, the entire key 63 is moved to the right, as viewed in FIG. 6, to move the plunger 54 and thereby release the balls 51 and 52.

FIG. 7 illustrates the insertion into the lock 46 of an incorrect key 64 having a spacing between the abutment 64a and the finger 64b which is greater than the corresponding spacing between the abutment 63a and the fingers 63b. FIG. 7 illustrates the position of the finger 64b after they have been retracted so as to grip the pin 56 and before an attempt is made to move the entire key 64 to the right. It will be observed that in this position, the fingers 64b prevent movement of the balls 60 and 61 completely out of the groove 62, and therefore, when an attempt is made to move the entire key 64 to the right, movement of the key 64, and hence, the plunger 54, is prevented by reason of engagement of the balls 60 and 61 with the wall of the groove 62. In this way, release of the balls 51 and 52, and unlocking of the lock 46 with an incorrect key is prevented.

Similar results would be obtained if a rigid tube is driven into the lock 46 in place of the key 64. Thus, if the tube has an outer diameter sufficient to engage the side wall of the cavity into which the balls 60 and 61 extend, portions of the balls 60 and 61 will be held in the groove 62, by the tube which will resist movement of the plunger 54. If the tube has an outer diameter sufficient to hold portions of the balls 60 and 61 in the groove 62 and if the inner diameter of the tube is such as to cause the tube to grip the pin 56, then, movement of the plunger 54 by the tube will be resisted.

FIGS. 6a and 7a show a lock generally similar to that of FIGS. 6 and 7, but equipped with an extra set of locking balls 60a and 61a spaced from the locking balls 60 and 61. These additional locking balls function similarly to the additional locking balls of the embodiments of FIGS. 3A–3C in that they require a key to have an arcuate recess properly located to receive the locking balls 60a and 61a to prevent the radially outward movement of the locking balls into the peripheral groove 62a. FIG. 6A shows the operation of a correct key 163 which is similar to the key 63 except for the fact that the key 163 has a circumferential recess R which is opposed to the groove 62a when the key 163 is in its unlocking position.

The improper key 164 shown in FIG. 7A cannot unlock the mechanism of FIGS. 6A and 7A. Not only does the key 164 have a spacing between the abutment and finger ends, like the key 64 of FIG. 7, but also, the key 164 has no circumferential recess R to allow inward movement of the locking balls 60a and 61a.

The lock 46a illustrated in FIGS. 8 and 9 contains both a modified plunger 65 and a modified pin 66, the balls 60 and 61 being restrained or released dependent upon the position of the pin 66. The pin 66 has a peripheral groove 67 which, when the pin 66 is in its normal position shown in FIG. 8, permits the balls 60 and 61 to move out of the groove 62. However, when the pin 66 is moved to the left, as shown in FIG. 9, the outer surface of the pin 66 prevents the balls 60 and 61 from moving out of the groove 62. Accordingly, if an attempt is made to open the lock 46a with an implement which holds the pin 66 in the position shown in FIG. 9, movement of the plunger 65 from its locking position to its unlocking position will be prevented. Also, if a rod, such as the rod 68 shown in FIG. 9 is inserted in the lock 46a and is driven against the pin 66 with sufficient force to bend the pin 66 or to deform it, such as at 69, by an amount which will cause the pin 66 to remain in the position shown in FIG. 9, then, the plunger 65 cannot thereafter be moved toward its unlocking position even by a correct key, the latter indicating tampering with the lock 46a.

FIG. 10 shows how any and all of the locking balls in the various embodiments of the mechanism of the invention can be kept from falling out of the axially inner ends of their respective passageways and/or grooves. The locking ball B of FIG. 10 can be taken to represent any of the locking balls previously discussed, and the passageway P in which the ball B is lodged for inward and outward movement represents any of the passageways in which the locking balls have been shown. It will be seen that although the passageway P has a slightly larger diameter than the ball B for free to and fro motion of the ball, the open end, or mouth M of the passageway P is of a smaller diameter than the ball B. Thus the ball B may protrude from the passageway mouth M but cannot fall out of the passageway P. To form a passageway one can simply drill the passageway P and stop drilling before the drill has passed completely through the surrounding material, leaving a lip at the mouth of the passageway.

Figure 11:
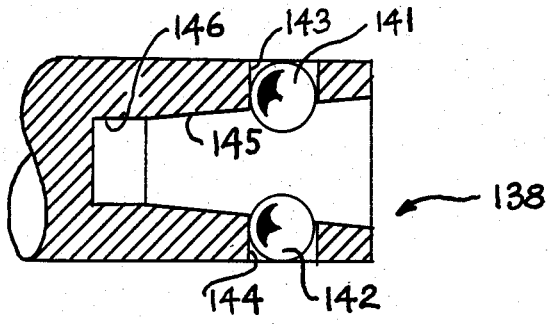
FIG. 11 is a detail view in section of a socket having a tapered wall in accordance with the invention.

FIG. 11 illustrates another modification of a plunger type lock of the type illustrated in U.S. Pat. No. 4,040,279 and briefly described above in connection with FIGS. 4 and 5. In a lock of this type a plunger socket is engageable by outwardly expandable fingers of a key (not shown in FIG. 11).

The socket 138 of FIG. 11, like the socket 38 of FIG. 4, has locking balls 141 and 142 received in passageways 143 and 144. A portion 145 of the socket wall, through which the passageways 143 and 144 extend tapers outwardly toward the open end of the socket 138. Inwardly of the tapered, or frusto-conical wall portion 145, the socket wall is cylindrical, as shown at 146.

It will be understood that an authorized key will be so dimensioned for use in conjunction with a socket of the type shown in FIG. 11 that the key fingers will engage the cylindrical wall portion 146 of the socket, to the rear of the locking balls 141, 142, to open the lock, which otherwise operates like the lock of FIGS. 4 and 5. An attempt to open a lock fitted with a socketed plunger according to FIG. 11 with an unauthorized key will result in failure of the key to engage the tapered portion 145 of the socket wall, or will cause the locking balls 141, 142 to move outward into grooves and thus prevent unlocking.

Figure 12:
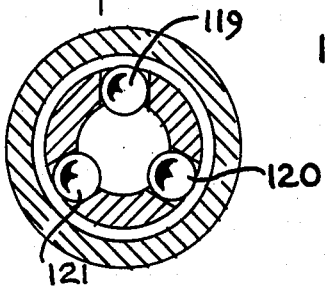
FIG. 12 is a view in section similar to that of FIG. 2, but showing three locking balls equally radially spaced about a socket.

FIG. 12 is similar to FIG. 3 in showing an arrangement of locking balls arranged in a socket's wall, except that three such balls 119, 120 and 121 are shown mounted at angles of 120 degrees with respect to each other about the axis of the figure. The use of three balls rather than two as in FIG. 2 assures that at least one of the balls 119, 120 or 121 will be driven outward to engage a matching groove if a foreign object such as an unauthorized key is inserted into the lock. The arrangement of FIG. 12 can be employed whether or not the socket has a tapered inner wall.

Figure 13:
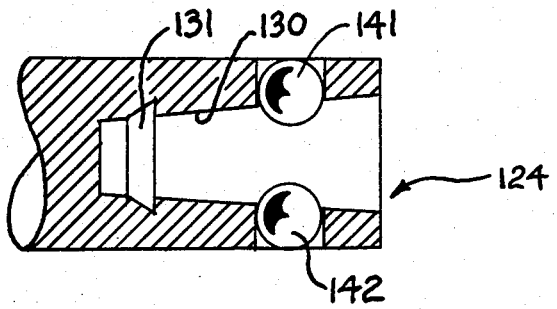
FIG. 13 shows another form of socket having a tapered wall.
Figure 14:
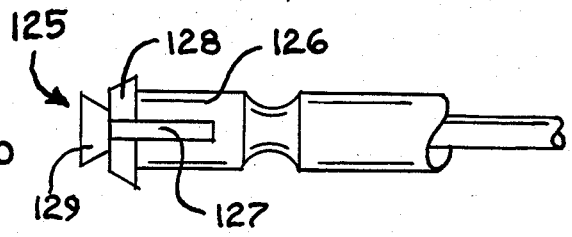
FIG. 14 is a detail view of the socket-engaging end of a key adapted for use in conjunction with a socket of the type shown in FIG. 13.

FIGS. 13 and 14 show a key 125 and socket 124 for more positive engagement. As in the embodiment of FIG. 5, the key 125 of FIG. 4 has fingers 126 separated by grooves 127 so that the fingers 126 can be expanded radially outward for engagement with the socket wall 130 by means such as those fully described in U.S. Pat. No. 4,040,279, the disclosure of which is hereby incorporated by reference.

Unlike the key and socket of said patent, the key of FIG. 14 and socket of FIG. 13 are provided with mating projections 128 on the key fingers 126 and a recess 131 in the socket wall 130, which wall 130 is tapered as previously described.

When a key 125 of the proper length is extended into the socket of FIG. 13 the projections 128 will fit into the mating recess 131 upon the expansion outward of the fingers 126 by the wedging action of the tip 129 of the key's central rod. The locking balls and locking ball receiving groove shown in FIGS. 13 and 14 function as already described.

Although preferred embodiments of the present invention have been described and illustrated, it will be apparent to those skilled in the art that various modifications may be made without departing from the principles of the invention.

What is claimed is:

1. A plunger type lock comprising a barrel with an axial bore, locking members on said barrel and extensible outwardly from said barrel, plunger means movable axially within said bore and in a first axial, locking position thereof, holding the locking members in extended position, said plunger means in a second axial, unlocking position permitting the locking members to move inwardly of said barrel, means biassing said plunger means into its first axial position, and means for preventing axial movement of said plunger means into its second axial position comprising at least one further locking member carried by said plunger means and movable inwardly and outwardly of said plunger means, said barrel having stop means engageable with said further locking member when said plunger means is in its first axial position and said further locking member extends outwardly of said plunger means, whereby displacement of said further locking member outwardly of said plunger means with an implement when said plunger means is in its locking position causes said further locking member to engage said stop means and prevents axial movement of said plunger means toward its second axial position.

2. A lock as set forth in claim 1 wherein said barrel has an opening therein at one end thereof for the entrance of expansible key means into the bore of said barrel, wherein said plunger means has a socket therein which opens toward said end of said barrel, said socket having a first wall surface portion engageable by said key means to cause said plunger means to move into its second axial position as the key means is retracted from said bore, and wherein said further locking member is located at a second portion of the wall surface of said socket which is farther from said end of said barrel than said first portion of the wall surface.

3. A lock as set forth in claim 1 wherein said barrel has an opening therein at one end thereof for the entrance of expansible key means into the bore of said barrel, wherein said plunger means has a socket therein which opens toward said end of said barrel, said socket having a first wall surface portion engageable by said key means to cause said plunger means to move into its second axial position as the key means is retracted from said bore, and wherein said further locking member is located at a second portion of the wall surface of said socket which is closer to the end of said barrel than said first portion of the wall surface.

4. A lock as set forth in claim 2 or 3 wherein said further locking member is a ball located in and movable in a passageway in said plunger means which extends from said socket to the outer periphery of said plunger means and wherein said stop means is a groove in the interior wall of said barrel which extends around the axis of said bore and which receives a portion of said ball when it extends outwardly of said plunger means.

5. A lock as set forth in claim 4 wherein said ball has a diameter greater than the radial thickness of the wall of said socket adjacent thereto but not greater than the radius of the outer surface of said wall.

6. A lock as set forth in claim 4 wherein said passageway has dimensions which permit said ball to extend into said socket but which prevent said ball from falling into said socket.

7. A lock as set forth in claim 4 wherein the diameter of said passageway at said socket is less than the diameter of said ball.

8. A lock as set forth in claims 1, 2, 3 or 4 wherein said plunger means has two parts, one of said parts carrying said further locking member and having an axial bore and the other of said parts being a piston with a shaft within the bore of said one part and being axially movable with respect to said one part, said other part being biassed by spring means toward said one part and said piston holding said first-mentioned locking members extended when said one part is moved axially without maintaining said piston in the position thereof when said plunger means is in its first axial position.

9. A lock as set forth in claim 8 wherein one end of the axial bore of said one part is adjacent said further locking member and wherein, in the first axial position of said plunger means, the end of said shaft remote from said piston is at said one end of the axial bore of said one part to prevent insertion of an implement in the axial bore of said one part when it is in its first axial position.

10. A lock as set forth in claim 4 wherein said plunger means has two parts, one of said parts having said passageway in which said ball is disposed and having an axial bore and the other of said parts being a piston with a shaft within the bore of said one part and being axially movable with respect to said one part, said other part being biassed by a spring means toward said one part and said piston holding said locking members extended when said one part is moved axially without maintaining said piston in the position thereof when said plunger means is in its first axial position and wherein the diameter of said ball is less than the radius of the outer surface of said one part whereby said piston is in its first axial position by a rod extending into the bore of said one part and engaging the end of said shaft without moving said ball outwardly of said one part.

11. A lock as set forth in claim 1 wherein said barrel has an opening therein at one end thereof for the entrance of key means into the bore of said barrel, wherein said plunger means has pin means thereon which is movable axially of said plunger means and part of which extends from said plunger means and part of which extends from said plunger means toward said end of said barrel, said pin means being engageable by said key means to cause said plunger means to move into its second axial position as the key means is retracted from said bore, and wherein said further locking member is located at a portion of said plunger means which is farther from said end of said barrel than at least a portion of said part of said pin means.

12. A lock as set forth in claim 1 wherein said barrel has an opening therein at one end thereof for the entrance of key means into the bore of said barrel, wherein said plunger means has pin means thereon which is movable axially of said plunger means and part of which extends from said plunger means toward said end of said barrel, said pin means being engageable by said key means to cause said plunger means to move into its second axial position as the key means is retracted from said bore, and wherein said further locking member is located at a portion of said plunger means which is closer to said end of said barrel than said part of said pin means.

13. A lock as set forth in claim 11 wherein said plunger means has a wall extending around at least a portion of said part of said pin means with its inner surface spaced from the latter and wherein said further locking member is located in said wall.

14. A lock as set forth in claim 11 wherein said plunger means has a bore into which said pin means extends, wherein said further locking member is located in the wall of said first-mentioned bore and wherein said pin means has a portion which is engageable with said further locking member when said pin means is moved in the direction away from said end of said barrel for engaging said locking member with said stop means.

15. A lock as set forth in claim 14 wherein said further locking member is a ball located in and movable in a passageway in the wall of said bore of said plunger means, wherein said pin means has a peripheral groove in the portion thereof which is within said bore of said plunger means for receiving a portion of said ball when said pin is in its position nearest said one end of said barrel and wherein said stop means is a groove in the interior wall of said barrel which extends around the axis of said bore of said barrel and which receives a portion of said ball when it extends outwardly of said plunger means and further comprising spring means biassing said pin means into said position thereof.

16. A lock as set forth in claim 11 or 12 wherein said further locking member is a ball located in and movable in a passageway in said plunger means and said stop means is a groove in the interior wall of said barrel which extends around the axis of said bore of said barrel which receives a portion of said ball when it extends outwardly of said plunger means.

17. In a key, for use with a barrel type lock, having a central rod-like element, an elongated tubular sleeve concentric with and slidable along said rod-like element, said tubular sleeve having an enlarged end, a plurality of relatively flexible fingers positioned radially outward of said sleeve, means for moving said enlarged end between the rod-like element and the fingers to force said fingers radially away from said rod-like member, the improvement comprising one or more peripheral grooves in and around a finger or fingers of the key to cooperate with radially movable locking means of the barrel type lock.

18. A grabber-type key for use with a barrel lock of the type having an internal plunger, having means to grip a pin associated with said plunger, the improvement comprising one or more peripheral grooves in and around the key to cooperate with radially movable locking means of said plunger of the barrel type.

19. A key for a plunger type lock of the type which engages a plunger of such a lock by expansion of an end of the key, including one or more peripheral grooves formed in the key at or near an expanding end of the key for cooperating with radially movable internal locking means of said plunger of the lock.

20. The key of claim 17 including a radially extending projection at a free end of each said relatively flexible finger for engagement with mating means of said barrel lock.

21. The lock of claim 2 wherein said socket has a wall which is tapered outwardly toward said end of said barrel.

22. The lock of claim 1 wherein said plunger means has a socket therein which opens toward said end of said barrel, said socket having a portion which tapers outwardly toward said opening and a cylindrical wall portion which is further from said socket opening for engagement by said key means.

23. The lock of claim 22 wherein said at least one further locking member is located at said cylindrical wall portion.

24. The lock of claim 1 wherein there are three of said further locking members arranged at equally arcuate spaces around said plunger means.

* * * * *